US006640814B1

(12) United States Patent
Burke

(10) Patent No.: US 6,640,814 B1
(45) Date of Patent: Nov. 4, 2003

(54) MASCARA APPLICATION SHIELD AND HAND-HELD SHIELD HOLDER

(76) Inventor: Ellen J. Burke, 18739 Hatteras St., Unit 54, Tarzana, CA (US) 91356

( * ) Notice: Subject to any disclaimer, the term of this patent is extended or adjusted under 35 U.S.C. 154(b) by 0 days.

(21) Appl. No.: 10/126,812

(22) Filed: Apr. 22, 2002

(51) Int. Cl.[7] ..... A45D 40/30
(52) U.S. Cl. ..... 132/319
(58) Field of Search ..... 132/319, 320, 132/285, 333, 216; 2/15, 202, 206, 207

(56) References Cited

U.S. PATENT DOCUMENTS 2,033,691 A * 3/1936 Douglass ..... 2/202
4,807,650 A * 2/1989 Bliss ..... 132/319
5,050,624 A * 9/1991 Kobe et al. ..... 132/319
5,191,897 A * 3/1993 Meshel ..... 128/745
5,957,142 A * 9/1999 Karafilis ..... 132/319
6,199,560 B1 * 3/2001 North et al. ..... 132/319

* cited by examiner

*Primary Examiner*—John J. Wilson
*Assistant Examiner*—Robyn Kieu Doan
(74) *Attorney, Agent, or Firm*—Allan M. Shapiro

(57) ABSTRACT

A shield holder has a manually-engageable handle on its lower end and a spoon-shaped panel on its upper end. It is curved from top to bottom. The shield holder releaseably holds a mascara shield made of soft, flexible sheet material provided with repositionable pressure-sensitive adhesive. The mascara shield is held under the eyelashes when mascara is being applied to avoid deposit of the mascara on the skin below the eyes. The handle is long enough and curved enough to hold the shield in place when it is positioned by hand, without interfering with the mascara-applying hand.

14 Claims, 2 Drawing Sheets

FIG. 3
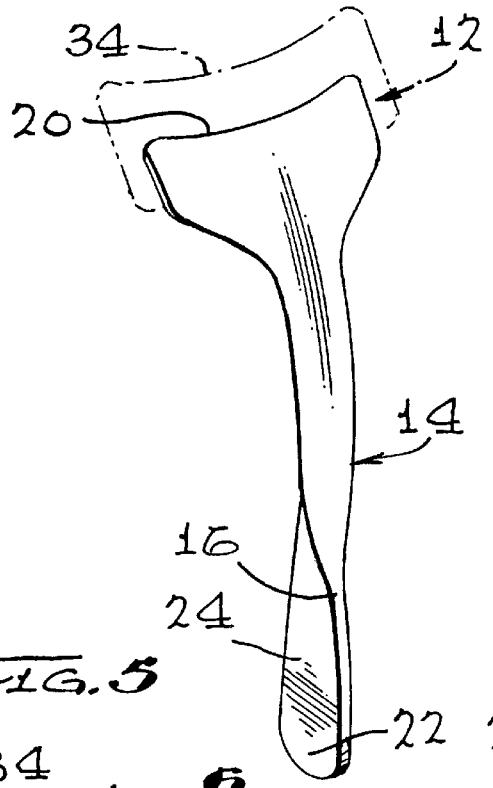
FIG. 4
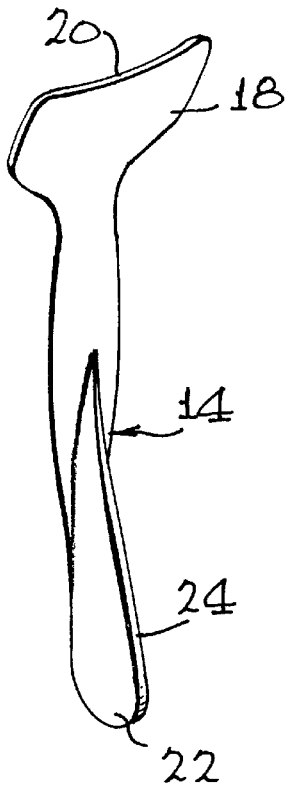
FIG. 5
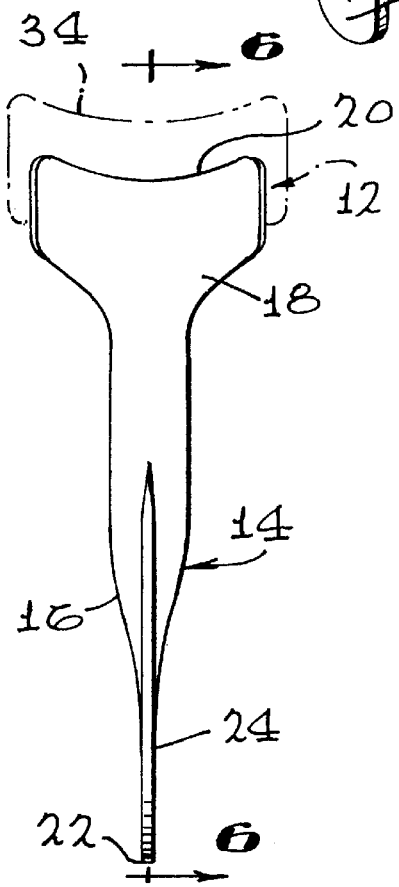
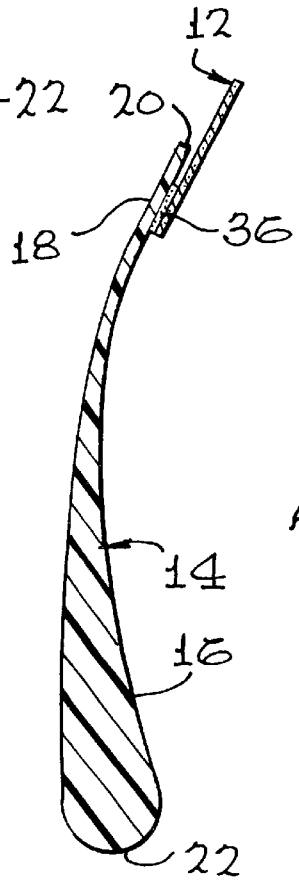
FIG. 6

MASCARA APPLICATION SHIELD AND HAND-HELD SHIELD HOLDER

FIELD OF THE INVENTION

The mascara application shield is removably attached to a shield holder and is configured so that the shield can be held under the eyelashes during mascara application.

BACKGROUND OF THE INVENTION

Many women feel that it enhances their beauty to apply makeup. There is a wide variety of makeup, including facial powdering to cover perceived blemishes, lip coloring and gloss and makeup around the eyes. The makeup around the eyes is to draw attention to and enhance the beauty of the eyes. Various eye enhancement treatments are employed. The eyebrows are plucked, shaped and colored. The eye sockets are colored above and below the eyes, often with a dark color, including blues.

The eyelashes are part of the makeup procedure. Mascara is brushed onto the eyelashes to bring them into more prominence. This is achieved by coloring the eyelashes with a dark color and with a material which gives the impression of lengthened eyelashes. Mascara is brushed onto the upper eyelash with the eyelid open. It is brushed in an upward and outward direction. With the eyelid open, the upper eyelashes are sufficiently away from the eye recess below the eyebrow so that mascara is not deposited thereon. When mascara is applied to the lower eyelashes, the lower eyelashes lie close to the cheek. Outward and downward brushing of mascara onto the lower eyelashes may result in depositing some of this mascara onto the cheek adjacent the eye. This is undesirable and wiping it off with a tissue sometimes causes damage to the makeup just below the eye. Of course it is better to avoid depositing the mascara at any location where it is not wanted, but it is more undesirable to have it come onto a surface that has already been treated with makeup. Thus, it is desirable to have a mascara application shield which overcomes the problem of mascara deposition onto the cheek, just below the eyes.

SUMMARY OF THE INVENTION

In order to aid in the understanding of this invention, it can be stated in essentially summary form that it is directed to a mascara application shield which is sized and shaped to lie directly below the lower eyelashes during mascara application and to a handle to which the shield is detachably attached so that the shield may be moved into position where it is effective during mascara application.

It is thus a purpose and advantage of this invention to supply a mascara application shield which aids in preventing the mascara from being deposited in undesired areas.

It is another purpose and advantage of this invention to provide a mascara application shield which is detachably secured to a hand-held shield holder so that the shield can be readily manipulated from a distance so that the hand holding the shield does not interfere with mascara application.

It is a further purpose and advantage of this invention to provide a mascara application shield which is a throwaway shield which can be readily detached from its shield holder and can be disposed of.

It is a further purpose and advantage of this invention to provide a mascara application shield which is inexpensive so that a new shield can be employed for every mascara application, with the shield detachably attached to the shield holder so that the shield holder can be easily re-used with a new shield.

It is another purpose and advantage of this invention to provide a mascara application shield which is curved and which is flexible so that it can be pressed into place to cover the desired area to be protected, without mascara being able to reach thereunder and without excessive application force so that the eye and/or surrounding tissue are not harmed.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 3 is a perspective view generally from the front of the shield holder, with the shield being shown in broken lines.

FIG. 4 is a perspective view from the rear of the shield holder.

FIG. 5 is an elevational view from the rear of the shield holder, with the shield being shown in broken lines.

FIG. 6 is a section taken generally along the line 6—6 of FIG. 5, and further including a mascara application shield attached thereto.

DESCRIPTION OF THE PREFERRED EMBODIMENTS

Figure 1:
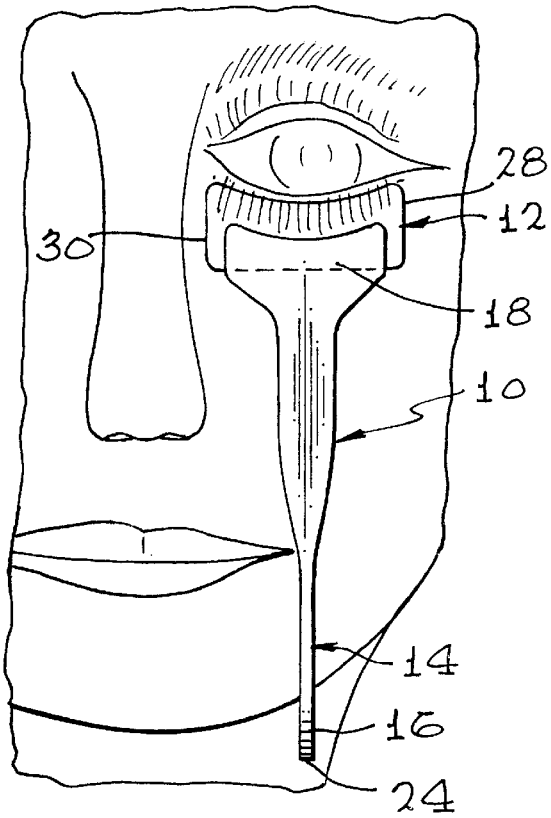
FIG. 1 is a front view of the mascara application shield and hand-held shield holder of this invention in association with the eyelashes to which mascara is to be applied, and showing a portion of the adjacent face.
Figure 2:
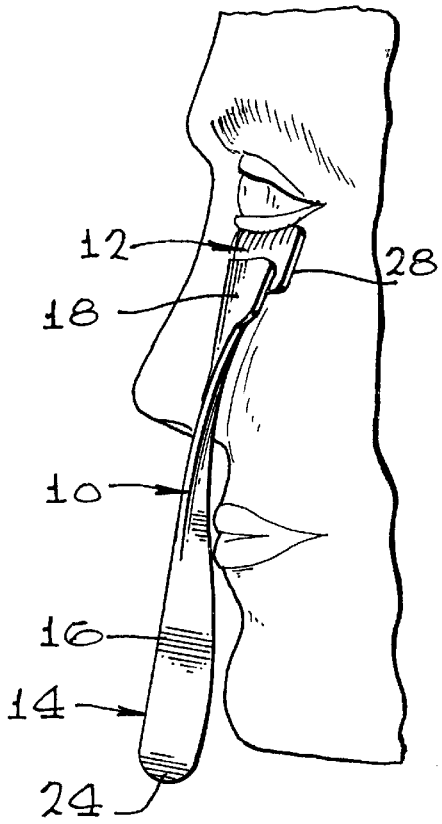
FIG. 2 is a side elevational view thereof.

The mascara application shield and hand-held shield holder is generally indicated at 10 in FIGS. 1 and 2. The shield is generally indicated at 12 and the hand-held shield holder is generally indicated at 14. As best seen in FIGS. 3, 4, 5 and 6, the shield holder has a handle 16 and a spoon-shaped panel 18 at the upper end of the handle. The spoon-shaped panel has a concavely curved top edge 20. The distance from the top edge 20 to the bottom end 22 of the handle is longer than the distance from the lower eyelashes of the user to her chin, as best seen in FIGS. 1 and 2. The shield holder 14 is curved from top to bottom so that the top is at a correct angle under the eye when the holder is held in the hand and the holder is clear of the face when properly held. An angle of 25 degrees between the panel 18 and the lower end of handle 16 is suitable. The lower portion of the handle has a blade 24 which is generally positioned front to back when the concave top edge of the spoon-shaped panel lies under the user's eye. This blade is configured to be comfortably held between the thumb and first and second fingers so as to be accurately positionable by the user, with the hand in a comfortable position. Only the lower portion of the handle is in the configuration of a blade oriented in the front-to-back direction. The cross-section changes from front to back orientation to lateral orientation toward the top of the handle and at the spoon-shaped panel, as is seen in FIG. 6.

The top edge 20 of the spoon-shaped panel 18 is downwardly curved when seen from the front, see FIGS. 1 and 5.

In addition, the spoon-shaped panel 18 is concave-curved to the curvature of the face under the eyes. A top view of the panel 18 is not seen, but this curvature can be seen in FIG. 2 where the panel 18 has positive curvature outward from the face under the eye. The shield holder 14 can be conveniently injection-molded of thermoplastic synthetic polymer composition material, to accurately achieve the desired shapes. The shield holder is to hold, shape and position the shield to help achieve the desired shielding results. The shield holder is long enough so that the lower end 22 is below the chin, so that the hand holding the shield holder is not in the way of the mascara-applying hand during manipulation of the shield holder.

Figure 7:
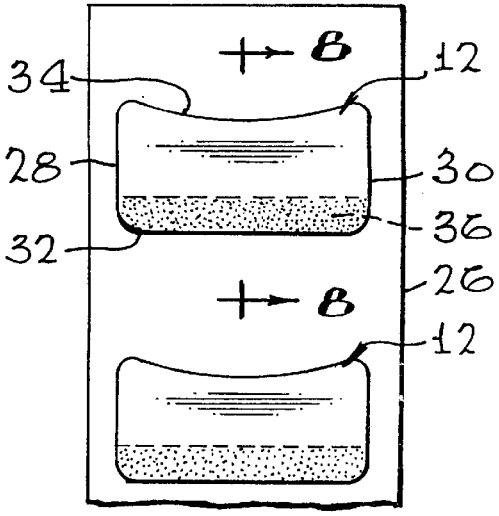
FIG. 7 is a plan view of the backing sheet, showing a plurality of the mascara application shields attached thereto.
Figure 8:
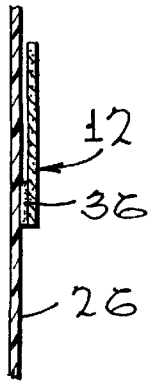
FIG. 8 is a section taken generally along the line 8—8 of FIG. 7.

Shield 12 is shown in FIGS. 7 and 8 as being separately supplied mounted on the release sheet 26. The shield 12 has left and right edges 28 and 30. The left and right directions are identified in the direction the user is looking. These edges are parallel to each other and substantially at a right angle to the bottom edge 32. Those edges are straight while the top edge 34 is concavely shaped to generally fit the curvature under the eye, as seen in FIG. 1. The shield 12 is thus substantially rectangular, with rounded corners and a concave top edge 34. The shield is attached to the release sheet 26 by means of a band of repositionable adhesive 36, which extends about a third of the height of the shield and is adjacent the lower edge 32 thereof.

The shield 12 is removed from the release sheet and, employing the same repositionable adhesive, is attached to the inside of the panel 18. As seen in FIGS. 1, 2, 3, 4, 5 and 6, about one third of the shield is covered by the top portion of the panel 18 and about two thirds extends beyond the top edge 20 of the shield holder. Since the adhesive is repositionable, these proportions can be adjusted by the user to achieve optimal protection based on the user's own unique facial dimensions. The shield 12 is made of soft polymer foam sheet material about 1/16 inch thick. The shield is of either closed cell foam or has a skin thereon so that mascara is not absorbed. The shield is sufficiently flexible so that it bends around the interior curve of the spoon-shaped panel, as seen in FIG. 2. The portion of the shield extending beyond the top edge 20 of the shield holder permits the shield to form itself to the shape of the under-eyelash configuration. The shield is sufficiently soft and flexible so that it does not apply substantial pressure to the under-eye area.

When the woman wants to apply mascara, she takes her shield holder 14 in hand. She removes one of the shields 12 from its release sheet 26. She attaches the shield 12 to the inside of the panel 18, with the adhesive toward the shield holder. This adhesive remains pressure-sensitive and releaseably holds the shield on the shield holder. By grasping the handle 16 the woman places the top curved edge 34 of the shield beneath her lower eyelashes. The 25 degree curve of the handle correctly places the shield under the eyelashes and the handle clears the face to permit accurate positioning. She uses her other hand to bring the mascara brush into place and, with the eye open, brushes mascara onto the upper eyelashes in an upward direction. She then brushes the mascara in a downward direction onto her lower eyelashes. Excess mascara is not deposited on the skin under the eyes, but is caught on the front surface of the shield. An accurate application of mascara is achieved. The process is repeated on the other eye and is then complete. The shield 12 may be reused, if there is little mascara on it, or may be thrown away and replaced if there is considerable mascara deposited on it. While this invention has been described for use by a women, it is not gender limited and can be used by actors and others.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A mascara application shield and hand-held shield holder, said hand-held shield holder having an upper end and a lower end, said shield holder having a spoon-shaped panel adjacent its upper end, said spoon-shaped panel being concave toward the user's face, said hand-held shield holder being configured adjacent its lower end to be manually grasped to manipulate said shield holder;

said mascara application shield being detachably attached to said shield holder at its upper end, said shield being made of foam synthetic polymer composition material, said shield being attached to said spoon-shaped panel so that said shield is formed into a curve which is concave toward the user's face, said shield being flexible so that it can be positioned beneath the user's eyelashes by manual manipulation of said shield holder so that mascara can be applied to the eyelashes while the shield is in position below the lower eyelashes to receive excess mascara and prevent the excess mascara from being deposited upon the user's skin below her eyes.

2. The mascara application shield and hand-held shield holder of claim 1 wherein said shield is detachably attached to said shield holder by means of repositionable pressure-sensitive adhesive.

3. The mascara application shield and hand-held shield holder of claim 2 wherein there are several additional of said shields laterally attached to a release sheet so that said shield can be removed from said shield holder and an additional shield can be releaseably attached to said shield holder.

4. The mascara application shield and hand-held shield holder of claim 1 wherein said shield holder has a handle below said spoon-shaped panel, said handle being sufficiently long so that it extends below the user's chin when said shield is positioned below the user's eye, to permit convenient manipulation and positioning of said shield and allow for the user's hand holding the shield holder not to interfere with the user's hand applying the mascara.

5. The mascara application shield and hand-held shield holder of claim 4 wherein said handle has a blade which is positioned at substantially a right angle to said spoon-shaped panel so that, when said handle is manually grasped, said spoon-shaped panel lies in its proper orientation.

6. A mascara application shield comprising:

a shield of sheet foam thermoplastic synthetic polymer composition material having a face and a back and having a top edge and a bottom edge, said top edge being concavely curved and said back adjacent said bottom edge having repositionable pressure-sensitive adhesive thereon, said shield lying on a release sheet, said shield being for use with a hand-held shield holder which has an upper end and a lower end, the lower end being configured to be manually graspable below the user's chin and the upper end having a front and a back, said back being concave toward the user's face said shield being configured so that a plurality of said shields can lie laterally with respect to each other on the release sheet to be releaseably attached to the back of the shield holder adjacent its upper end so that said shield extends above the top of the shield holder, said shield being sufficiently flexible so as to bend to the curve of said concave back to fit the user's face so that said shield can be manually positioned below the lower eyelashes by manual manipulation of the shield holder, so that, during application of mascara to the eyelashes, the skin below the eyelashes is protected from mascara application.

7. The mascara application shield of claim 6 further including a shield holder in combination.

8. The mascara application shield and hand-held shield holder of claim 7 wherein said shield holder is sufficiently long so that said lower end of said shield holder extends below the user's chin when said shield is positioned below the user's eyelashes.

9. The mascara application shield and hand-held shield holder of claim 8 wherein the lower end of said shield holder has a blade which is positioned to be manually grasped while said shield is positioned under the user's lower eyelashes.

10. The mascara application shield and hand-held shield holder of claim 7 wherein said shield holder is curved between said upper end and said lower end to an angle of substantially 25 degrees so that said shield can be properly positioned below the eyelashes and said handle clears the user's face.

11. The mascara application shield and hand-held shield holder of claim 7 wherein said shield holder is sufficiently long so that said lower end of said shield holder extends below the user's chin when said shield is positioned below the user's eyelashes.

12. The mascara application shield and hand-held shield holder of claim 11 wherein the lower end of said shield holder has a blade which is positioned to be manually grasped while said shield is positioned under the user's lower eyelashes.

13. The method of protecting the user's skin below the eyes during the application of mascara comprising the steps of:

fashioning a shield holder which has an upper end and a lower end and is sufficiently long so that it can be manually grasped below the chin when the upper end lies at the user's lower eyelashes;

attaching a plurality of flexible foam polymer mascara shields laterally to each other on a release sheet;

removing a selected shield from the release sheet;

releaseably attaching the selected shield to the shield holder by means of pressure-sensitive adhesive;

manipulating and positioning the shield holder so that the shield lies against the user's face below the eye beneath the lower eyelashes;

applying mascara to the lower eyelashes by brushing mascara downwardly thereon while protecting the face by holding the mascara shield in position underneath the lower eyelashes.

14. The method of claim 13 further including the terminal step of:

removing the shield from the shield holder by pulling the shield away against the pressure-sensitive adhesive and disposing of the shield so that a new shield can be removed from the release sheet and can be installed for the next mascara application.

* * * * *